US009418526B1

(12) United States Patent
Davis

(10) Patent No.: US 9,418,526 B1
(45) Date of Patent: Aug. 16, 2016

(54) PEDESTRIAN SECURITY DYE PACK SYSTEM

(71) Applicant: Donnell A. Davis, Bowie, MD (US)

(72) Inventor: Donnell A. Davis, Bowie, MD (US)

( * ) Notice: Subject to any disclaimer, the term of this patent is extended or adjusted under 35 U.S.C. 154(b) by 0 days.

(21) Appl. No.: 14/616,120

(22) Filed: Feb. 6, 2015

(51) Int. Cl.
*G08B 23/00* (2006.01)
*G08B 15/02* (2006.01)

(52) U.S. Cl.
CPC ..... *G08B 15/02* (2013.01)

(58) Field of Classification Search
CPC ..... G08B 21/02; G08B 21/08
USPC ..... 340/573.1, 539.13, 539.1, 13.26, 384.1; 441/80
See application file for complete search history.

(56) References Cited

U.S. PATENT DOCUMENTS 5,029,293 A * 7/1991 Fontanille ..... G08B 21/088 340/539.1
6,246,329 B1 * 6/2001 King ..... G08B 5/40 116/211
6,486,777 B2 * 11/2002 Clark ..... G08B 21/0227 340/539.1
6,922,149 B1 * 7/2005 Ford ..... A41D 1/005 340/539.1
8,031,078 B1 * 10/2011 Liestman ..... G08B 15/004 340/573.1
8,310,360 B2 * 11/2012 Ross, Jr. ..... G08B 15/02 340/539.1
2006/0117981 A1 * 6/2006 Williams ..... G08B 15/004 102/335

* cited by examiner

*Primary Examiner* — Phung Nguyen
(74) *Attorney, Agent, or Firm* — Crossley and Stevenson Intellectual Property Law

(57) ABSTRACT

The pedestrian security dye pack system serves as a key component of law enforcement efforts across countries and communities as an investigative tool in emergency response situations, as an eyewitness in investigations and prosecutions, and as a citizen-driven virtual guard and security system. Via included multiple airwave communications, identification and notification capabilities such as WiFi, Bluetooth®, GPS, RFID, and dye projector, the pedestrian security dye pack system isolates, reports and aids authorities in offender detection and apprehension by offering the advantages of a wearable parental unit and a plurality of accompanying dye packs with a radio-controlled incendiary propelled dye projector in each.

3 Claims, 3 Drawing Sheets

PEDESTRIAN SECURITY DYE PACK SYSTEM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Municipalities across the country are in a constant search for effective public safety interventions that will curb crime and improve the livability and economic well-being of their communities. There thus exists a perpetual goal to embrace public safety effort for the stated purposes of crime deterrence and prevention along with criminal conviction. Incorporating a community policing philosophy can serve as a key component of law enforcement efforts across countries and communities as an investigative tool in emergency response situations, as an eyewitness in investigations and prosecutions, and as a citizen-driven virtual guard and security system.

The pedestrian security dye pack system isolates, reports and aids authorities in offender detection and apprehension by offering the advantages of a wearable parental unit and a plurality of accompanying dependents with a dye pack radio-controlled incendiary device in each. The system provides optical and audible alarms, a wireless camera, a smartphone application, active and passive global positioning system, hereinafter "GPS", for first responders and others to locate a victim. The apparel-adhesive is provided for both the transmitter device and the dye packs and provides for transferable reusability.

FIELD OF THE INVENTION

The present pedestrian security dye pack system relates to personal security devices and more especially to a pedestrian security dye pack system that aids authorities in criminal detection and apprehension.

SUMMARY OF THE INVENTION

The general purpose of the pedestrian security dye pack system, described subsequently in greater detail, is to provide a pedestrian security dye pack system that has many novel features that result in a pedestrian security dye pack system which is not anticipated, rendered obvious, suggested, or even implied by prior art, either alone or in combination thereof.

To accomplish this, the pedestrian security dye pack system comprises a transmitter device having a front side spaced apart from a back side, a top end spaced apart from a bottom end, and a first end spaced apart from a second end.

A transmitter device is part of the system. The transmitter device has a battery pack disposed within. A central processing unit, hereinafter "CPU", is disposed within the transmitter device and is in communication with the battery pack. The CPU has an erasable programmable read only memory, hereinafter "EPROM", a clock, and a programmable logic controller, hereinafter "PLC", disposed within. The CPU and battery pack are further in operational communication with other elements contained within the transmitter device, including a solar panel disposed within the top end, and a speaker disposed in each of the first end and the second end. A camera is disposed within the front side. A universal serial bus port, hereinafter "USB port", is disposed in the first end and enables charging without the solar panel as well as a plethora of direct exterior device communications.

Further elements disposed within the transmitter device and in communication with the CPU and the battery pack are a Bluetooth® wireless interconnectivity, GPS, a local area wireless technology that allows an electronic device to exchange data or connect to the internet via radio waves, hereinafter "WiFi", an input-output bridge, hereinafter "I/O bridge", a transceiver, a panic button, and a centrally disposed touch-display screen in the front side.

A removably applied dye pack is an integral element of the system. A reusable adhesive importantly provides for dye pack transfer as needed. The dye pack is in operational communication with the transmitter device. The dye pack has a battery power in operational communication with the following elements: radio-frequency identification, hereinafter "RFID", a dye projector, and a receiver.

A depression of the panic button activates the dye projector of the dye pack in order to stain a perpetrator or other pertinent item or location. The panic button further engages the camera, the touch-display screen, the speakers, and the I/O bridge. The panic button can be held to operate a delay functionality.

In operation, a user initiates a discharge of wearable security dye from at least one dye pack, the dye pack worn on person or clothing or carry item, as example. Of importance is that multiple dye packs can be used with a single transmitter device. The initiation is accomplished by pressing the panic button. Upon system detection of initiation the aerosol projector emits a dye and optionally other detection chemicals which can also include repellents. A stain, such as Disperse Red 9™, can be used as the dye, as example. Upon initiation the radio transceiver also communicates thru the I/O bridge to the camera, the speakers, the GPS, the containing WiFi, the Bluetooth®, the RFID, an existing smartphone, and existing law enforcement and other authorities. Smartphones and other potentially useful airwave communicable devices and functions are also alerted from the transmitter device through the I/O bridge.

Extended features include a brilliant flash emitted from the dye pack as discouragement and a siren emitted through the speakers. The location of the elements of the system is important in order to accomplish a compact size and weight conducive to non-invasive wear by a user and users of the transmitter device and the dye packs.

Thus has been broadly outlined the more important features of the pedestrian security dye pack system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
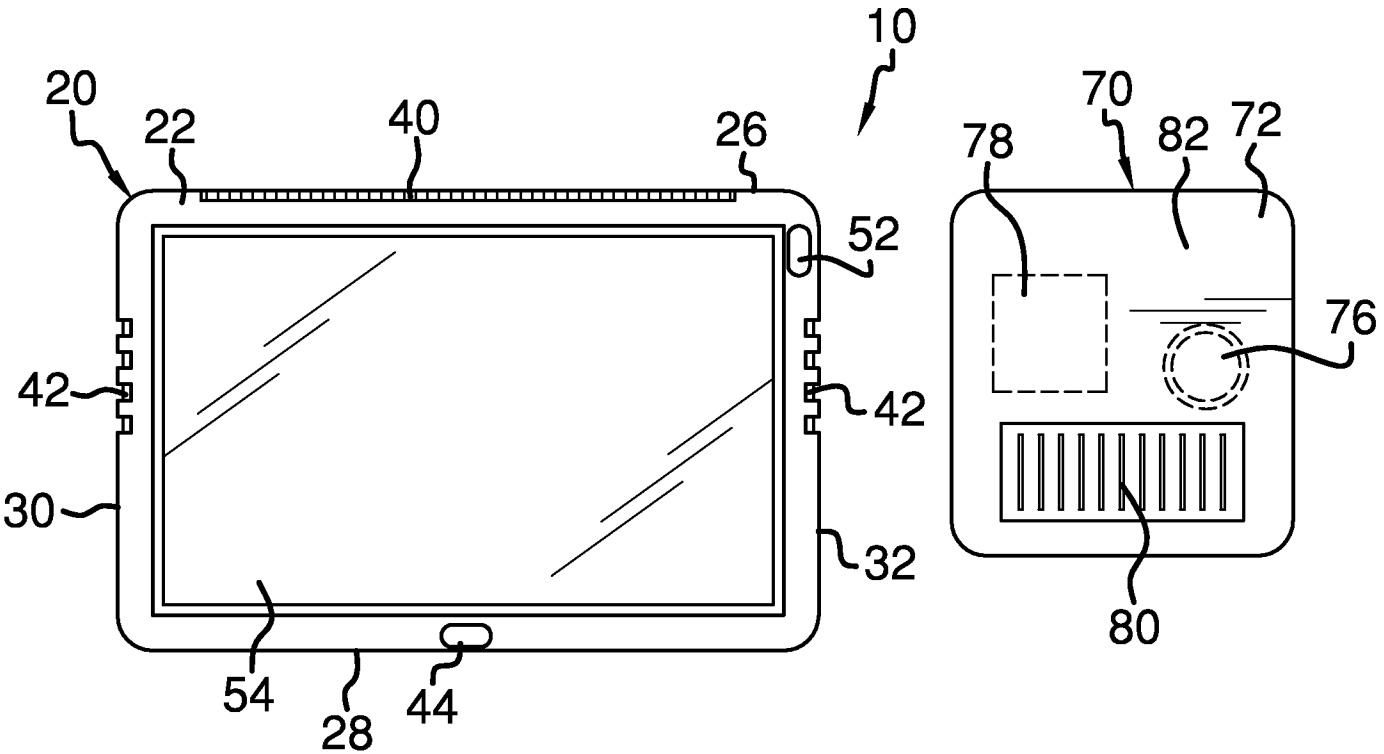
FIG. 1 is a top frontal view of a transmitter device and a dye pack of a pedestrian security dye pack system.
Figure 2:
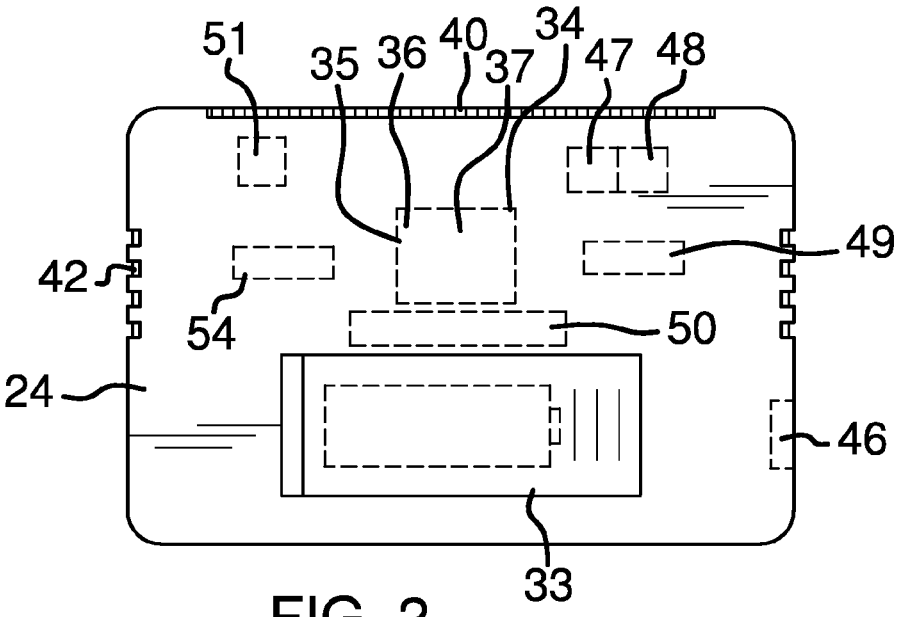
FIG. 2 is a front side detail view of the transmitter device.
Figure 3:
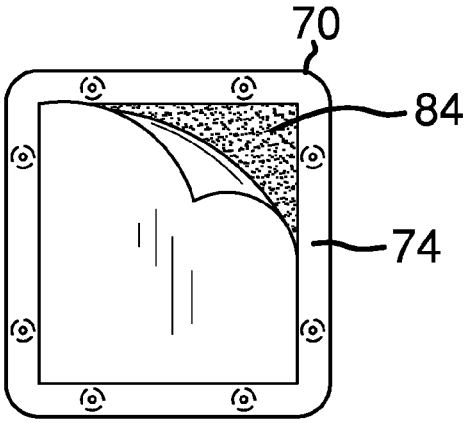
FIG. 3 is a rear side of the dye pack.
Figure 4:
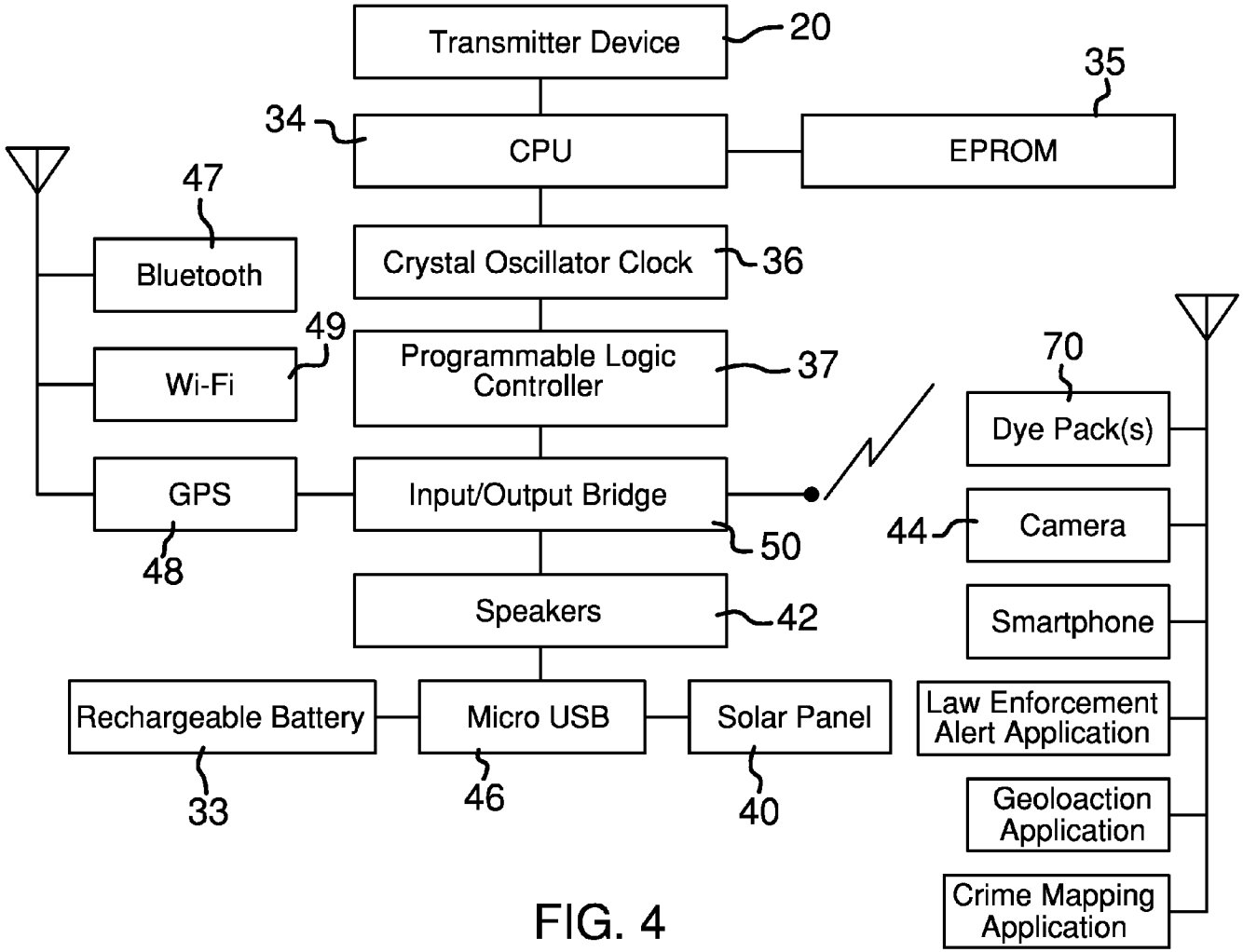
FIG. 4 is a schematic block diagram of a communication of the system and communication with a plurality of existing external media.

With reference now to the drawings, and in particular FIGS. 1 through 4 thereof, an example of the pedestrian security dye pack system employing the principles and concepts of the present pedestrian security dye pack system and generally designated by the reference number 10 will be described.

Referring to FIGS. 1 through 4, the pedestrian security dye pack system 10 comprises a transmitter device 20 having a front side 22 spaced apart from a back side 24, a top end 26 spaced apart from a bottom end 28, and a first end 30 spaced apart from a second end 32.

A transmitter device 20 is part of the system 10. The transmitter device 20 has a battery pack 33 disposed within. A CPU 34 is disposed within the transmitter device 20 and is in communication with the battery pack 33. The CPU 34 has an EPROM 35, a clock 36, and a PLC 37 disposed within. The CPU 34 and battery pack 33 are further in operational communication with other elements contained within the transmitter device 20, including a solar panel 40 disposed within the top end 26, an at least one speaker 42 disposed in each of the first end 30 and the second end 32. A camera 44 is disposed within the front side 22. A USB port 46 is disposed in the first end 30.

Further elements disposed within the transmitter device 20 and in communication with the CPU 34 and the battery pack 33 are a Bluetooth® 47, GPS 48, WiFi 49, and I/O bridge 50, a transceiver 51, a panic button 52, and a centrally disposed touch-display screen 54 in the front side 22.

A plurality of removably applied dye packs 70 is an integral element of the system 10. Each dye pack 70 has a pack front side 72 spaced apart from a pack back side 74. Each dye pack 70 is in operational communication with the transmitter device 20. Each dye pack 70 has a battery power 76 in operational communication with the following elements: an RFID 78, dye projector 80, and a receiver 82. The removable adhesive 84 provides for reapplication of the dye packs 70 to various garments and users.

A depression of the panic button 52 activates the dye projector 76 of the dye pack 70 in order to stain and even repel a perpetrator and to potential stain a pertinent item or location. The panic button 52 further engages the camera 44, the touch-display screen 54, the speakers 42, and the I/O bridge 50.

What is claimed is:

1. A pedestrian security dye pack system comprising:

a transmitter device having a front side spaced apart from a back side, a top end spaced apart from a bottom end, a first end spaced apart from a second end, the transmitter device comprising:

a CPU disposed within the transmitter device, the CPU having an EPROM, a clock, a PLC, the CPU in operational communication with:

a camera;

a USB port;

a Bluetooth®;

a GPS;

a WiFi;

an I/O bridge;

a transceiver;

a panic button;

a touch-display screen;

a battery pack;

a removably applied dye pack in operational communication with the transmitter device, the dye pack having a battery power in operational communication with:

an RFID;

a dye projector;

a receiver; and a reusable adhesive bonded to the pack back side;

wherein a depression of the panic button activates the dye projector, the camera, the touch-display screen, an at least one speaker, the I/O bridge.

2. A pedestrian security dye pack system comprising:

a transmitter device having a front side spaced apart from a back side, a top end spaced apart from a bottom end, a first end spaced apart from a second end, the transmitter device comprising:

a CPU disposed within the transmitter device, the CPU having an EPROM, a clock, a PLC, the CPU in operational communication with:

a solar panel;

a speaker;

a camera;

a USB port;

a Bluetooth®;

a GPS;

a WiFi;

an I/O bridge;

a transceiver;

a panic button;

a touch-display screen;

a battery pack;

a removably applied dye pack in operational communication with the transmitter device, the dye pack having a battery power in operational communication with:

an RFID;

a dye projector;

a receiver; and a reusable adhesive bonded to the pack back side;

wherein a depression of the panic button activates the dye projector, the camera, the touch-display screen, an at least one speaker, the I/O bridge.

3. A pedestrian security dye pack system comprising:

a transmitter device having a front side spaced apart from a back side, a top end spaced apart from a bottom end, a first end spaced apart from a second end, the transmitter device comprising:

a CPU disposed within the transmitter device, the CPU having an EPROM, a clock, a PLC, the CPU in operational communication with:

a solar panel disposed within the top end;

a speaker disposed in each of the first end and the second end;

a camera disposed within the front side;

a USB port disposed in the first end;

a Bluetooth®;

a GPS;

a WiFi;

an I/O bridge;

a transceiver;

a panic button disposed on the front side;

a touch-display screen disposed centrally within the front side;

a battery pack accessible through the back side;

a plurality of removably applied dye packs in operational communication with the transmitter device, each dye pack having a pack front side spaced apart from a pack back side, each dye pack having a battery power in operational communication with:

an RFID;

a dye projector; and a receiver; and a reusable adhesive bonded to the pack back side;

wherein a depression of the panic button activates the dye projector, the camera, the touch-display screen, an at least one speaker, the I/O bridge.

* * * * *